US008926341B2

(12) United States Patent
Chen

(10) Patent No.: US 8,926,341 B2
(45) Date of Patent: Jan. 6, 2015

(54) ELECTRICAL CONNECTOR

(71) Applicant: OUPIIN Electronic (Kunshan) Co., Ltd, Kunshan (CN)

(72) Inventor: Hsin Chih Chen, Kunshan (CN)

(73) Assignee: OUPIIN Electronic (Kunshan) Co., Ltd, Kunshan (CN)

( * ) Notice: Subject to any disclaimer, the term of this patent is extended or adjusted under 35 U.S.C. 154(b) by 0 days.

(21) Appl. No.: 14/024,828

(22) Filed: Sep. 12, 2013

(65) Prior Publication Data

US 2014/0187096 A1 Jul. 3, 2014

(30) Foreign Application Priority Data

Dec. 28, 2012 (CN) ..... 2012 10 580518

(51) Int. Cl.
*H01R 12/00* (2006.01)
*H01R 13/516* (2006.01)

(52) U.S. Cl.
CPC ..... *H01R 13/516* (2013.01)
USPC ..... 439/79

(58) Field of Classification Search
USPC ..... 439/79, 80, 947
See application file for complete search history.

(56) References Cited

U.S. PATENT DOCUMENTS

| | | | | |
|---|---|---|---|---|
| 6,890,214 | B2 * | 5/2005 | Brown et al. | 439/607.39 |
| 7,520,760 | B2 * | 4/2009 | Margulis et al. | 439/79 |
| 8,366,458 | B2 * | 2/2013 | Ngo et al. | 439/79 |
| 8,821,169 | B2 * | 9/2014 | Ng | 439/79 |
| 2005/0186813 | A1 * | 8/2005 | Lohr | 439/79 |

* cited by examiner

*Primary Examiner* — Phuong Dinh

(57) ABSTRACT

An electrical connector is provided in the present invention, including an insulating housing, a first group of conductive terminals, a second group of conductive terminals and a third group of conductive terminals. A mating section of the insulating housing forms a receiving cavity, which disposes at least one horizontal division plate therein to form multiple receiving semi-cavity. A horizontal retaining section and a vertical retaining section of each conductive terminal are received and retained into the mounting section of the insulating housing, the tails thereof extend outside the bottom surface of the mounting section, and the flexible contact section enters into the corresponding receiving semi-cavity of the mating section. The electrical connector of the present invention disposes a wider complementary margin along an up and down direction and a left and right direction, thereby ensuring a safe connection of the electrical connector and a complementary connector.

10 Claims, 6 Drawing Sheets

ELECTRICAL CONNECTOR

CROSS REFERENCE TO RELATED APPLICATION

This application claims the priority of Chinese Patent Application No. 201210580518.8, filed on Dec. 28, 2012 in the SIPO (State Intellectual Property Office of the P.R.C.).

BACKGROUND OF THE INVENTION

1. Field of the Invention

The present invention relates to a connector technical field, and particularly relates to a power transmission electrical connector.

2. Description of Prior Art

An electrical connector includes electrical features of durable and convenient, and is applicable in various industrial and commercial usages such as a power supply, a server, a router, a storage device, an industrial controller and a modular chassis etc. In the meanwhile, since several terminal configurations can be designed in the connector, applications of power source, signal and the combination thereof can be satisfied.

As is known to all, the docking accuracy of the electrical connector can directly affect the signal transmission accuracy in or between electronic devices. More strictly, in certain particular applications, join and disjoin of electrical connector even in unmanned circumstances are required, and the accurate transmission of power signal, control signal or communication signal can only be ensured by perfectly reliable docking of the electrical connector.

In general, for the sake of ensuring the docking accuracy of electrical connector, during the designing of the electrical connector, it is required to provide the electrical connector with a wider complementary margin.

For example, a power electrical connector is disclosed in Chinese Patent Publication No. CN100421306C, wherein the power electrical connector does not allow any wider complementary margin along left and right directions when being mated with a complementary connector. Further, when the complementary connector is inserted into the power electrical connector, if the complementary connector has a deviation along right or left direction, the two rows of terminals of the power connector are very likely to touch each other due to the deviation force, so that this will result in a signal transmission error.

Therefore, in the light of the defects and inconvenience in the structure of conventional power connector above-mentioned, the inventor provides a power connector that is disposed with a wider complementary margin along an up and down direction and a left and right direction, such that a normal electrical connection is ensured even when a complementary connector being biased up and down or left and right is inserted into the power connector.

SUMMARY OF THE INVENTION

One objective of the present invention is to provide an electrical connector with wider complementary margin to ensure the reliability of docking.

Other objectives and advantages of the present invention are described in detail from the technical features disclosed in the present invention.

To achieve the objectives, the present invention provides an electrical connector which comprises an insulating housing, and a plurality of conductive terminals. The insulating housing comprises a mating section on a front side thereof and a mounting section on a rear side thereof, a front surface of the mating section is perpendicular to a bottom surface of the mounting section; a receiving cavity backward extending from the front surface of the mating section is formed in the mating section and at least one horizontal isolated plate is disposed in the receiving cavity, and the horizontal isolated plate separates the receiving cavity in to a plurality of receiving semi-cavities which are arranged along an up and down direction; a plurality of terminal retaining channels are formed in the mounting section, the terminal retaining channels pass through a rear surface and the bottom surface of the mounting section and forward extend to the receiving cavity of the mating section; a plurality of conductive terminals, wherein each of the conductive terminals has a horizontal retaining section, an flexible contact section forward extend from the horizontal retaining section, a vertical retaining section bent and downward extend from the horizontal retaining section, and a tail downward extend from the vertical retaining section; and the horizontal retaining section and the vertical retaining section of the conductive terminal are received and retained in the terminal retaining channel of the mounting section of the insulating housing, and the tails thereof extend outside the bottom surface of the mounting section from the corresponding terminal retaining channel, and the flexible contact sections thereof extend into the corresponding receiving semi-cavities from the corresponding terminal retaining channels.

In one embodiment of the present invention, at least one heat channel is formed in each of the left and right side walls of the receiving cavity of the insulating housing.

In one embodiment of the present invention, each of the flexible contact sections of the conductive terminals comprises two dependent flexible fingers that are protruding opposite to each other, wherein one of the flexible fingers is protruding upward to form an upward contact surface while the other flexible finger is downward protruding to form a downward contact surface.

In one embodiment of the present invention, each of the flexible contact sections of the conductive terminals includes two flexible contact surfaces of two opposite directions.

In one embodiment of the present invention, each of the conductive terminals forms a plurality of tails, and the tails are in the form of needle-eyed shape.

In one embodiment of the present invention, the number of isolated plates disposed in the receiving cavity is two, and the receiving cavity is divided into three receiving semi-cavities which are arranged along an up and down direction, and the conductive terminals are divided into three groups comprising a first group of conductive terminals, a second group of conductive terminals, and a third group of conductive terminals, and the flexible contact sections of the first group of terminals extend into the receiving semi-cavity in the top of the insulating housing, and the flexible contact sections of the second group of terminals extend into the receiving semi-cavity in the middle of the insulating housing, the flexible contact sections of third group of terminals extend into the receiving semi-cavity in the bottom of the insulating housing.

In one embodiment of the present invention, each group of the first group of conductive terminals, the second group of conductive terminals, and the third group of conductive terminals includes two structurally symmetrical and conductive terminals.

In one embodiment of the present invention, the three groups of conductive terminals have identical structure and different sizes.

In one embodiment of the present invention, the horizontal retaining sections of the first group of conductive terminals are the longest, the horizontal retaining sections of the second group of conductive terminals are shorter, and the horizontal retaining sections of the third group of conductive terminals are the shortest, the vertical retaining sections of the first group of conductive terminals are the tallest, the vertical retaining sections of the second group of conductive terminals are shorter, and the vertical retaining sections of the third group of conductive terminals are the shortest.

In one embodiment of the present invention, the vertical retaining sections of the three groups of conductive terminals are arranged as two rows, so that the tails of the three groups of conductive terminals are arranged as two parallel and straight lines; the horizontal retaining sections of the three groups of conductive terminals are arranged hierarchical, thereby arranging the flexible contact sections in a matrix manner and the flexible contact sections are assembled into the corresponding receiving semi-cavities.

Compared to conventional technologies, since each of the flexible contact sections of conductive terminal of the electrical connector according to the present invention includes a deformability along up and down direction, and by disposing horizontal isolated plate to guarantee the safety during the docking of the electrical connector according to the present invention and the complementary connector, the electrical connector according to the present invention includes a wider complementary margin along an up and down, at the same time, since the flexible contact section of conductive terminal of the electrical connector according to the present invention are not required to, during docking with the plate-shaped receptacle terminals of the complementary connector, be accurately aligned left and right, and can be safely docked to the complementary connector by the flexible deformation of itself even when being biased to a certain extent. Moreover, by the designing of the heat channel, the electrical connector according to the present invention can guarantee a favorable heat dissipation during the operation of the electrical connector. As a result, by disposing a wider complementary margin along an up and down direction and a left and right direction, a normal connection of the electrical connector and the complementary connector is ensured when the complementary connector, being biased to an up and down direction or a left and right direction, is inserted.

DETAILED DESCRIPTION OF THE INVENTION

The following description is explained in conjunction with accompanying drawings to illustrate rather than limit the present invention.

Figure 1:
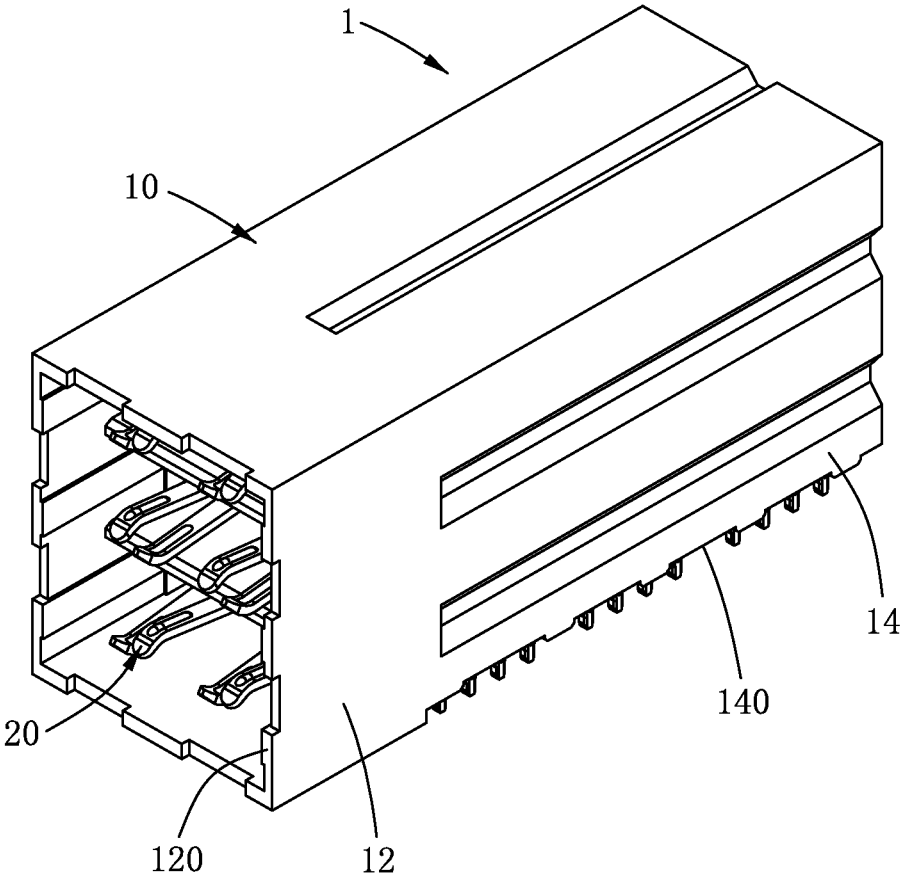
FIG. 1 is a perspective view of the electrical connector according to the present invention.
Figure 2:
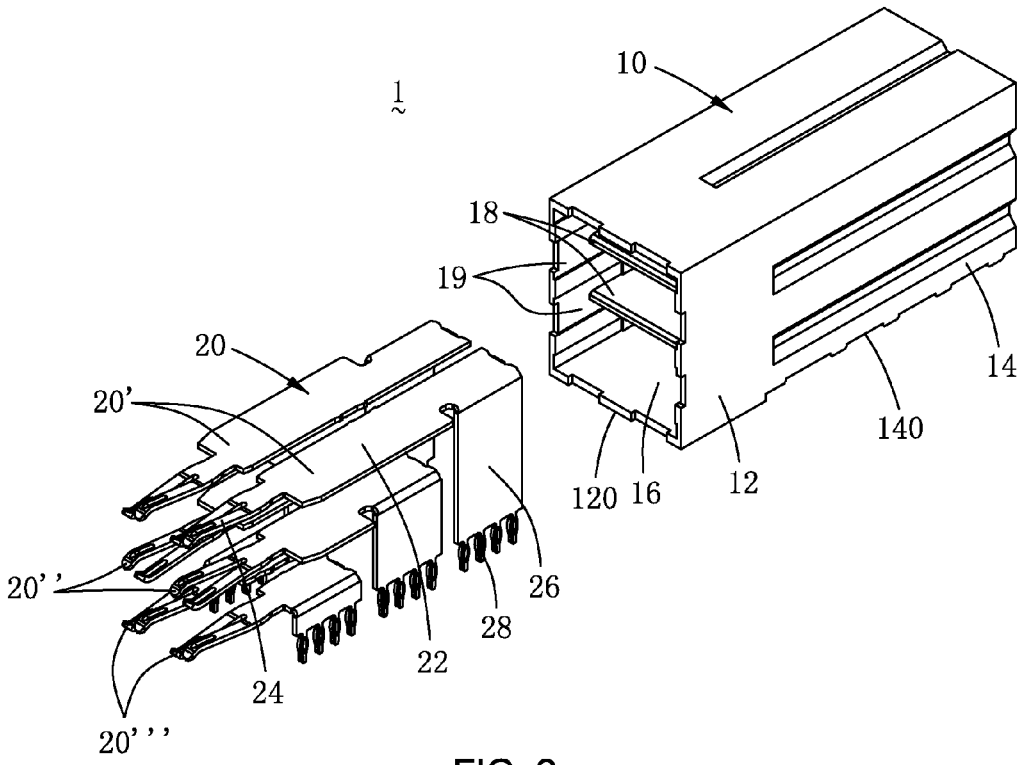
FIG. 2 is an exploded diagram of the electrical connector according to the present invention.
Figure 3:
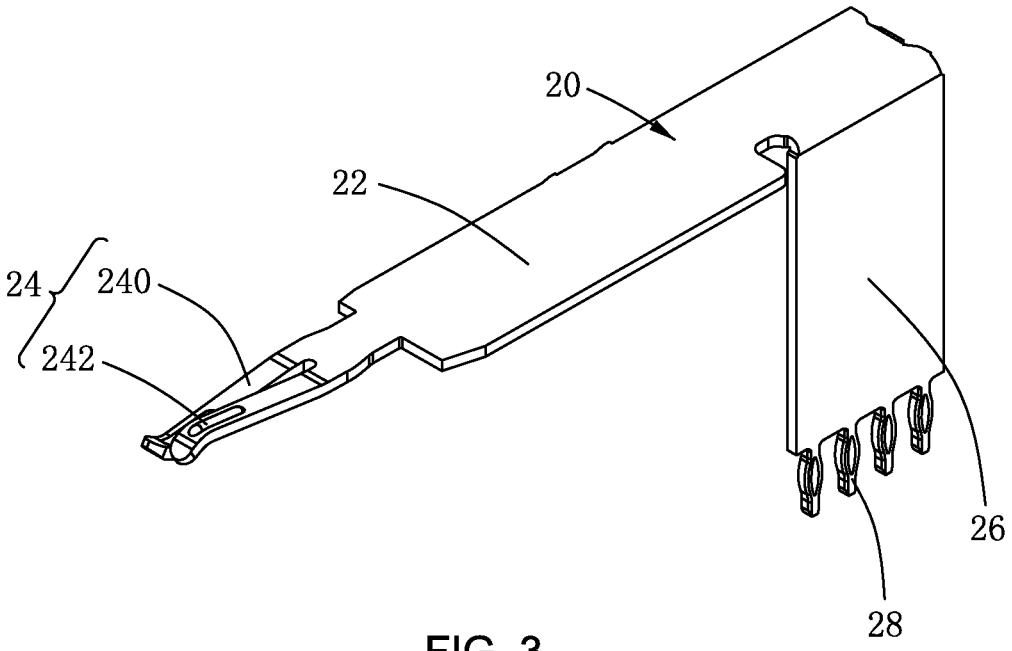
FIG. 3 is a structural diagram of the conductive terminal of the electrical connector according to the present invention.
Figure 4:
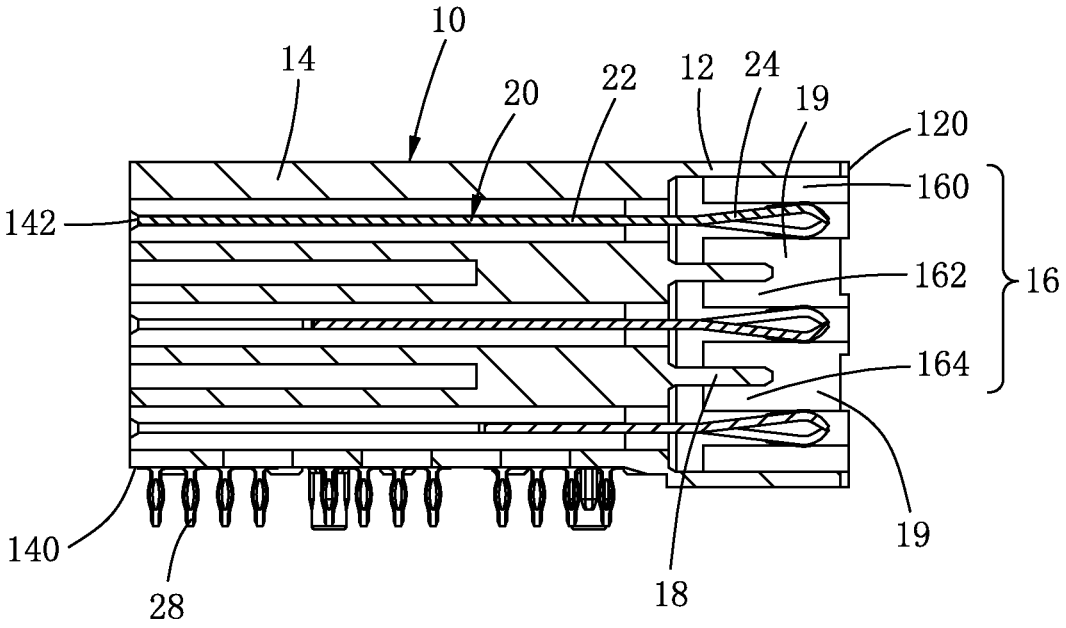
FIG. 4 is a vertical cross-sectional diagram of the electrical connector according to the present invention.
Figure 5:
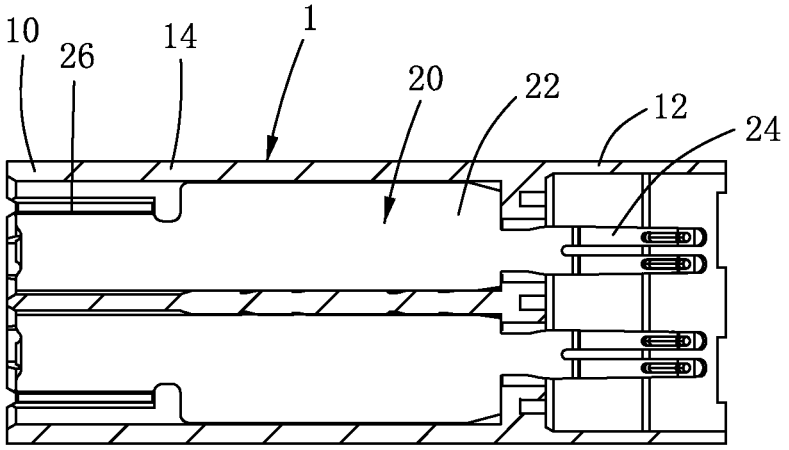
FIG. 5 is a horizontal cross-sectional diagram of the electrical connector according to the present invention.
Figure 6:
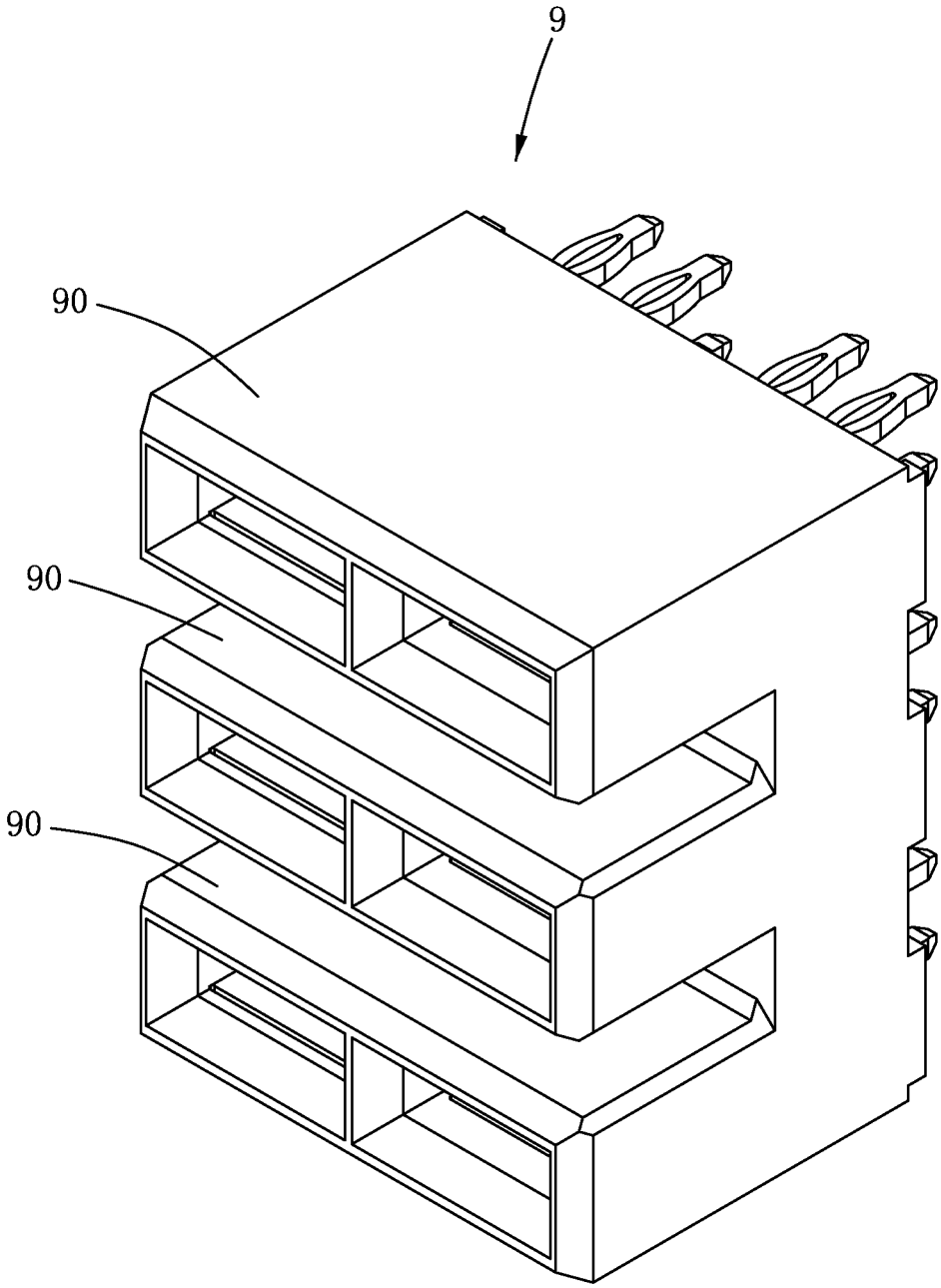
FIG. 6 is a perspective view of a complementary connector that is docked to the electrical connector according to the present invention.
Figure 7:
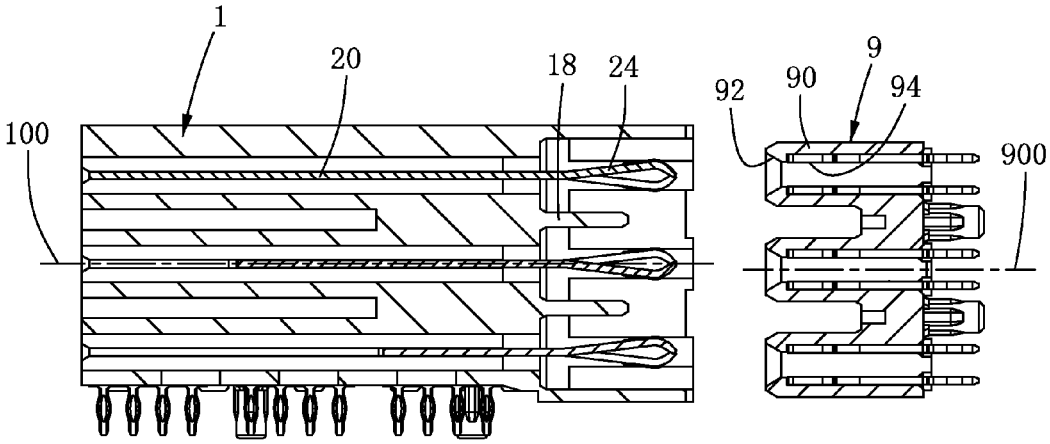
FIG. 7 illustrates the docking of the electrical connector and complementary connector 9, wherein the complementary connector is biased along an up and down direction.
Figure 8:
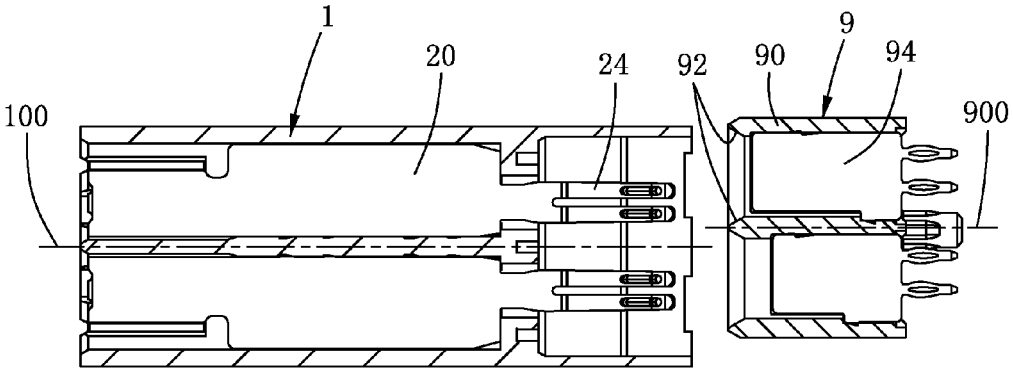
FIG. 8 illustrates the docking of the electrical connector and complementary connector, wherein the complementary connector is biased along a left and right direction.

Please refer to the power connector 1 illustrated in FIGS. 1 to 8 according to the present invention, wherein FIG. 1 is a perspective view of the electrical connector 1 according to the present invention; FIG. 2 is an exploded diagram of the electrical connector 1 according to the present invention; FIG. 3 is a structural diagram of the conductive terminal 20 of the electrical connector according to the present invention; FIG. 4 is a vertical cross-sectional diagram of the electrical connector 1 according to the present invention; FIG. 5 is a horizontal cross-sectional diagram of the electrical connector 1 according to the present invention; FIG. 6 is a perspective view of a complementary connector that is docked to the electrical connector 1 according to the present invention; FIG. 7 illustrates the docking of the electrical connector 1 and complementary connector 9, wherein the complementary connector 9 is biased along an up and down direction, and FIG. 8 illustrates the docking of the electrical connector 1 and complementary connector 9, wherein the complementary connector 9 is biased along a left and right direction.

As illustrated in FIGS. 1 and 2, the electrical connector 1 according to the present invention is an orthogonal plug connector which can be mounted onto a circuit board (not shown) in parallel. The electrical connector 1 comprises an insulating housing 10, and a plurality of conductive terminals 20.

In one embodiment, as illustrated in FIGS. 1 to 5, the insulating housing 10 is rectangular and comprises a mating section 12 on a front side thereof and a mounting section 14 on a rear side thereof, wherein a front surface 120 of the mating section 12 is perpendicular to a bottom surface 140 of the mounting section 14, when the electrical connector 1 is mounted onto the circuit board (not shown), the bottom surface 140 of the mounting section 14 is disposed on the circuit board while the front surface 120 of the mating section 12 extends outside the edge of the circuit board to be docked to a complementary connector 9 (please also refer to FIGS. 6 and 9).

Please refer to FIGS. 2 and 4, a receiving cavity 16 backward extending from the front surface 120 of the mating section 12 is formed in the mating section 12, two up and down separated and parallel horizontal isolated plates 18 are disposed in the receiving cavity 16, whereby the receiving cavity 16 is primarily divided into three up and down arranging receiving semi-cavities 160, 162, 164. Besides, two relatively wider heat channels 19 are respectively defined in each of the left and right side walls for heat dissipation. Details will be described later. It should be understood that the particular size of each horizontal isolated plate 19, such as the depth and the length from the front to the rear, can be decided by the structure of the complementary connector 9, therefore there is no limitation on the particular size of the horizontal isolated plate 18 according to the present invention and the particular size of the horizontal isolated plate 18 shall not be deemed as a limitation on the scope of the claims of the present invention as well. Besides, the number of the horizontal isolated plates is not limited in the present invention, yet the number is at least one, in other embodiments, the horizontal isolated plates can be counted three, four or even more. As a matter of fact, the particular number of horizontal isolated plates can be adjusted based on the arrangement of the conductive terminals as well as the actual docking structure.

Please refer to FIGS. 2 and 4, a plurality of terminal retaining channels 142 is formed in the mounting section 14 for receiving and retaining the conductive terminals 20. These terminal retaining channels 142 pass through the rear surface and bottom surface of the mounting section 14 and extend forward to the receiving cavities 16 of the mating sections 12. In the present invention, the terminal retaining channels 142 and conductive terminals 20 are equal in number, and the internal structure of the terminal retaining channel 142 is decided basically with reference to the structure of the conductive terminal 20.

Please refer to FIGS. 2 to 5, the conductive terminals 20 of the electrical connector 1 according to the present invention is mounted into the insulating housing 10, these conductive terminals 20 can be grouped into three, that is the first group of conductive terminals 20' the second group of conductive terminals 20" and the third group of conductive terminals 20'". Each of the conductive terminals 20', 20", 20'" includes two structurally symmetrical and conductive terminals. For instance, as illustrated in FIG. 2, the three group of conductive terminals 20', 20", 20'" have generally identical structures and different sizes.

Taking one conductive terminal 20 among others in the first group of conductive terminals 20' as an example, the structure of the conductive terminal 20 according to the present invention is described in detail as follows.

As illustrated in FIG. 3, the conductive terminal 20 according to the present invention includes a horizontal retaining section 22, an flexible contact section 24 forward extending from the horizontal retaining section 22, a vertical retaining section 26 that is vertically bent and downward extending from the horizontal retaining section 22, and a tail 28 downward extending from the vertical retaining section 26. In the present embodiment, the flexible contact sections 24 of the conductive terminal 20 are two independent flexible fingers 240, 242 that are respectively and oppositely protruding, wherein one of the flexible finger 242 is protruding upward and forming an upward contact surface while the other flexible finger 240 is protruding downward and forming a downward contact surface. In the present embodiment, each of the conductive terminals 20 forms a plurality of tails 28, and the tails are in the form of needle-eyed shape.

As illustrated in FIGS. 4 and 5, the horizontal retaining section 22 and vertical retaining section 26 of the conductive terminal 20 of the conductive terminal 20 can be retained at the mounting section 14 of the insulating housing 10 and received into the terminal retaining channels 142. The flexible contact section 24 of the conductive terminal 20 extends into the receiving cavity 16 of the mating section 12 from the terminal retaining channel 142 so as to facilitate the docking with the complementary connector 9. The tail 28 of the conductive terminal 20 extends outside the bottom surface 140 of the mounting section 14 from the terminal retaining channel 142 so as to facilitate the connection to the circuit board (not shown). In the present invention, as the tail 28 of the conductive terminal 20 is in the form of needle-eyed shape, the tails 28 can be retained into the electric conductive slots of the circuit board by pressure welding, thereby connecting to the power access points on the circuit board.

From the description above and with reference to FIGS. 1 and 2, the first, second and third conductive terminals 20', 20", 20'" according to the present invention have generally identical structures and the only difference is in size. For instance, the horizontal retaining sections 22 of the first group of conductive terminals 20' are the longest, the horizontal retaining sections of the second group of conductive terminals 20" are shorter, and the horizontal retaining sections of the third group of conductive terminals 20" are the shortest. Besides, the vertical retaining sections 26 of the first group of conductive terminals 20' are the tallest, the vertical retaining sections of the second group of conductive terminals 20" are shorter, and the vertical retaining sections of the third group of conductive terminals 20'" are the shortest. Basically, the vertical retaining sections 26 of the three groups of conductive terminals 20', 20", 20'" are arranged as two rows, so that the tails 28 of the three groups of conductive terminals 20', 20", 20'" are arranged as two parallel and straight lines. The horizontal retaining sections 22 of the three groups of conductive terminals 20', 20", 20'" are arranged hierarchically, thereby arranging the flexible contact sections 24 in a matrix manner and the flexible contact sections are, each two as a group, assembled into the corresponding receiving semi-cavities 160, 162, 164. More specifically, the flexible contact sections 24 of the first group of conductive terminals 20' enter the receiving semi-cavity 160 at the top of the mating section 12 of the insulating housing 10, the flexible contact sections of the second group of conductive terminals 20" enter the receiving semi-cavity 162 at the middle of the mating section, while the flexible contact sections of the third group of conductive terminals 20'" enter the receiving semi-cavity 164 at the middle of the mating section 12.

The docking of the electrical connector 1 to the complementary connector 9 according to the present invention is described as follows.

Please refer to FIGS. 6, 7 and 8, a complementary connector 9 has three semi-receptacle bodies 90 formed thereon, which are respectively corresponding to the three receiving semi-cavities 160, 162, 164 of the electrical connector according to the present invention.

As illustrated in FIG. 7, when the complementary connector 9 and the electrical connector 1 according to the present invention are docking and are biased along an up and down direction, i.e. the axis 900 of the complementary connector 9 is staggering with the axis 100 of the electrical connector according to the present invention along the up and down direction, such as 0.5 mm, since the flexible contact section 24 of the conductive terminal 20 of the electrical connector 1 according to the present invention is operable to bias up and down and the flexible deformation is within normal range, the flexible contact section 24 of the conductive terminal 20 can be biased along the chamfer 92 disposed on the semi-receptacle body 90 of the complementary connector 9, so as to successfully enter the complementary connector 9, thereby establishing a normal electrical connection with the receptacle terminal 94 in the complementary connector 9. Additionally, during the inserting of the receptacle body 90 of complementary connector into the receiving semi-cavities 160, 162, 164, since the isolated plate 18 is disposed between the up and down two adjacent rows of conductive terminals 20 of the electrical connector according to the present invention, therefore, when the flexible contact section 24 of the conductive terminal 20 is biased downward (or upward), no contact is expected to the adjacent row of conductive terminals 20 below (above), thereby a normal signal transmission is guaranteed.

As illustrated in FIG. 8, during the docking of the electrical connector according to the present invention to the complementary connector 9, due to the plate-shaped receptacle terminal 94 of the complementary connector 9, the conductive terminal 20 of the electrical connector according to the present invention is not strictly required to be accurately aligned along left and right to be connected. Furthermore, if the complementary connector 9 is biased along a left and right direction to about 1.0 mm, the flexible contact section 24 of the conductive terminal 20 of the electrical connector 1 according to the present invention can still successfully enter the complementary connector 9 along the chamfer 92 on the semi-receptacle body 90, thereby establishing a normal electrical connection with the plate-shaped receptacle terminal 94 in the complementary connector 9. Being biased, a slight interference (e.g. 0.07 mm) is formed by the flexible contact section 24 of conductive terminal 20 and the internal side wall of semi-receptacle body 90, which is, however, within the range of flexible deformation of the conductive terminal 20 and is not going to be broken. Moreover, since a heat channel 19 is formed in both the left and right side walls of the receiving cavity 16 of the electrical connector 1, so that when complementary connector 9 is inserted having axis 900 biased to the right (or left) of the axis 100 of the electrical connector 1, a certain space for air circulation is still reserved in the receiving cavity 16 of the electrical connector 1 according to the present invention, thereby facilitate the heat dissipation.

All in all, since the flexible contact section 24 of conductive terminal of the electrical connector 1 according to the present invention includes a deformability along up and down direction, and by disposing horizontal isolated plate 18 to guarantee the safety during the docking of the electrical connector according to the present invention and the complementary connector 9, the electrical connector 1 according to the present invention includes a wider complementary margin along an up and down, at the same time, since the flexible contact section 24 of conductive terminal 20 of the electrical connector according to the present invention are not required to, during docking with the plate-shaped receptacle terminals 94 of the complementary connector 9, be accurately aligned left and right, and can be safely docked to the complementary connector 9 by the flexible deformation of itself even when being biased to a certain extent. Moreover, by the designing of the heat channel 19, the electrical connector 1 according to the present invention can guarantee a favorable heat dissipation during the operation of the electrical connector 1. In a summary, by disposing a wider complementary margin along an up and down direction and a left and right direction, a normal connection of the electrical connector and the complementary connector is ensured when the complementary connector, being biased to an up and down direction or a left and right direction, is inserted.

What is claimed is:

1. An electrical connector comprising:

an insulating housing having a mating section on a front side thereof and a mounting section on a rear side thereof, wherein a front surface of the mating section is perpendicular to a bottom surface of the mounting section, and a receiving cavity backward extending from the front surface of the mating section is formed in the mating section, and at least one horizontal isolated plate is disposed in the receiving cavity, and the horizontal isolated plate separates the receiving cavity into a plurality of receiving semi-cavities which are arranged along an up and down direction; a plurality of terminal retaining channels are formed in the mounting section, the terminal retaining channels pass through a rear surface and the bottom surface of the mounting section and forward extend to the receiving cavity of the mating section;

a plurality of conductive terminals, wherein each of the conductive terminals has a horizontal retaining section, a flexible contact section forward extends from the horizontal retaining section, a vertical retaining section bent and downward extends from the horizontal retaining section, and a tail downward extends from the vertical retaining section, and the horizontal retaining section and the vertical retaining section of the conductive terminals are received and retained in the terminal retaining channels of the mounting section of the insulating housing, and the tails thereof extend outside the bottom surface of the mounting section from the corresponding terminal retaining channels, and the flexible contact sections thereof extend into the corresponding receiving semi-cavities from the corresponding terminal retaining channels.

2. The electrical connector as claimed in claim 1, wherein at least one heat channel is formed in each of the left and right side walls of the receiving cavity of the insulating housing.

3. The electrical connector as claimed in claim 1, wherein each of the flexible contact sections of the conductive terminals comprises two dependent flexible fingers that are protruding opposite to each other, wherein one of the flexible fingers is protruding upward to form an upward contact surface while the other flexible finger is downward protruding to form a downward contact surface.

4. The electrical connector as claimed in claim 1, wherein each of the flexible contact sections of the conductive terminals includes two flexible contact surfaces of two opposite directions.

5. The electrical connector as claimed in claim 1, wherein each of the conductive terminals forms a plurality of tails, and the tails are in the form of needle-eyed shape.

6. The electrical connector as claimed in claim 1, wherein the number of isolated plates disposed in the receiving cavity is two, and the receiving cavity is divided into three receiving semi-cavities which are arranged along an up and down direction, and the conductive terminals are divided into three groups comprising a first group of conductive terminals, a second group of conductive terminals and the third group of conductive terminals, and the flexible contact sections of the first group of terminals extend into the receiving semi-cavity in the top of the insulating housing, and the flexible contact sections of the second group of terminals extend into the receiving semi-cavity in the middle of the insulating housing, and the flexible contact sections of third group of terminals extend into the receiving semi-cavity in the bottom of the insulating housing.

7. The electrical connector as claimed in claim 6, wherein each group of the first group of conductive terminals, the second group of conductive terminals and the third group of conductive terminals includes two structurally symmetrical and conductive terminals.

8. The electrical connector as claimed in claim 7, wherein the three groups of conductive terminals have identical structures and different sizes.

9. The electrical connector as claimed in claim 8, wherein the horizontal retaining sections of the first group of conductive terminals are the longest, the horizontal retaining sections of the second group of conductive terminals are shorter, and the horizontal retaining sections of the third group of conductive terminals are the shortest, and the vertical retaining sections of the first group of conductive terminals are the tallest, and the vertical retaining sections of the second group of conductive terminals are shorter, and the vertical retaining sections of the third group of conductive terminals are the shortest.

10. The electrical connector as claimed in claim 9, wherein the vertical retaining sections of the three groups of conductive terminals are arranged as two rows, so that the tails of the three groups of conductive terminals are arranged as two parallel and straight lines, and the horizontal retaining sections of the three groups of conductive terminals are arranged hierarchically, thereby arranging the flexible contact sections in a matrix manner, and the flexible contact sections are assembled into the corresponding receiving semi-cavities.

* * * * *